US005144774A

United States Patent [19]

Conboy

[11] Patent Number: 5,144,774

[45] Date of Patent: Sep. 8, 1992

[54] DRY WALL SANDER

[76] Inventor: John S. Conboy, 215 Cedar Tree La., Ballwin, Mo. 63011

[21] Appl. No.: 598,049

[22] Filed: Oct. 16, 1990

Related U.S. Application Data

[62] Division of Ser. No. 369,247, Jun. 21, 1989, Pat. No. 4,974,371.

[51] Int. Cl.[5] ..... B24B 23/00

[52] U.S. Cl. ..... 51/170 TL; 51/180; 403/114

[58] Field of Search ..... 403/113-116, 403/56, 57, 74, 76, 90, 103; 51/392, 393; 81/177.6, 177.7, 177.75, 177.8; 15/144 A

[56] References Cited

U.S. PATENT DOCUMENTS

| | | | |
|---|---|---|---|
| 1,463,306 | 7/1923 | Bushnell | 403/114 X |
| 1,671,991 | 6/1928 | Lindner | 403/115 X |
| 4,457,188 | 7/1984 | Hauser | 403/114 X |
| 4,662,772 | 5/1987 | Schultz | 403/114 |
| 4,804,220 | 2/1989 | Rosheim | 403/114 X |

*Primary Examiner*—M. Rachuba

*Attorney, Agent, or Firm*—Gravely, Lieder & Woodruff

[57] ABSTRACT

A dry wall power sander having a reciprocating sanding head driven by pulsing solenoids with a ball and socket connection between the head and an elongated handle to allow movement of the head in two directions but not rotatary motion. Brake means are provided for locking head in a predetermined position with respect to the handle.

2 Claims, 2 Drawing Sheets

DRY WALL SANDER

This is a divisional of copending application Ser. No. 07/369,247 filed on Jun. 21, 1989, now U.S. Pat. No. 4,974,371.

BACKGROUND OF THE INVENTION

This invention relates to the field of electric hand tools and, in particular, relates to a dry wall sander which can be used by a craftsman while standing on the floor of a room or hall.

Presently sanding of the tape which is applied to dry wall joints is to a large degree done by hand. Conventional power sanders are not particularly suitable because much of the sanding must be done in corners and it is very easy to damage the adjacent wall or ceiling if the worker is not careful.

If hand sanding is done, it must be done by workers on stilts or scaffolding. Using an extension handle on a power sander is tiring because of the weight of the sander.

When using a sander on an extension handle to sand high walls and ceilings, it is important that the sanding head be movable, but that it be constrained against rotation. It also must be capable of being locked in a predetermined position.

It also is desirable that a sander be relatively light in weight because much of the work is done above the head of the user and excess weight results in fatigue to the user.

SUMMARY OF THE INVENTION

Accordingly, it is a principal object of this invention to provide a dry wall power sander in which a reciprocating sanding head is driven by a small motor or solenoid controlled by an electric switch that pulses at a set number of times per second.

It is a further principal object of this invention to provide a dry wall sander in which the sanding head is connected to an extended handle by a joint having a ball movable in a hollow semi-spherical shell with projections on the shell running in right anglularly positioned grooves in the outer wall of the ball to restrain relative rotation beween the ball and shell while permitting movement in two directions.

Still another object is to provide a dry wall sander having a joint between the sanding head and an extended handle with means to lock the head in a fixed position relative to the handle.

It is a further object of this invention to provide a dry wall sander with a reciprocating sanding surface in which the handle is connected to the head closely adjacent to the sanding surface to place the pivot point close to the work to reduce the tendency of the head to flip over while the sander is in use.

These and other objects and advantages will become apparent hereinafter.

The present invention comprises a dry wall sander having a reciprocating sanding head, an extended handle, and a joint connecting the head to the handle to restrain rotation movement of the head while still allowing movement of the head in two directions.

DESCRIPTION OF THE DRAWINGS

In the drawings where like numbers refer to like parts wherever they occur.

DETAILED DESCRIPTION

Figure 1:
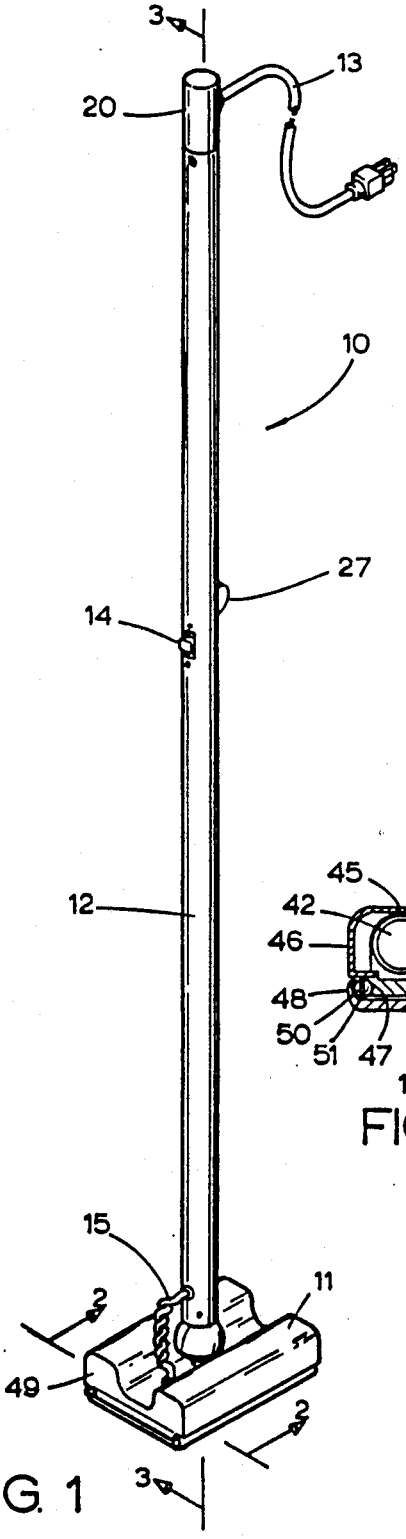
FIG. 1 is a plan view of the sander of this invention.

FIG. 1 shows the dry wall sander 10 which includes a movable sanding head 11 and an extended body member 12. Attached to the free end of the body 12 is an electrical conductor 13. The conductor 13 is connected to an actuator switch 14 which connects and interrupts current to a second conductor 15 to supply electrical energy to the sanding head 11.

Figure 3:
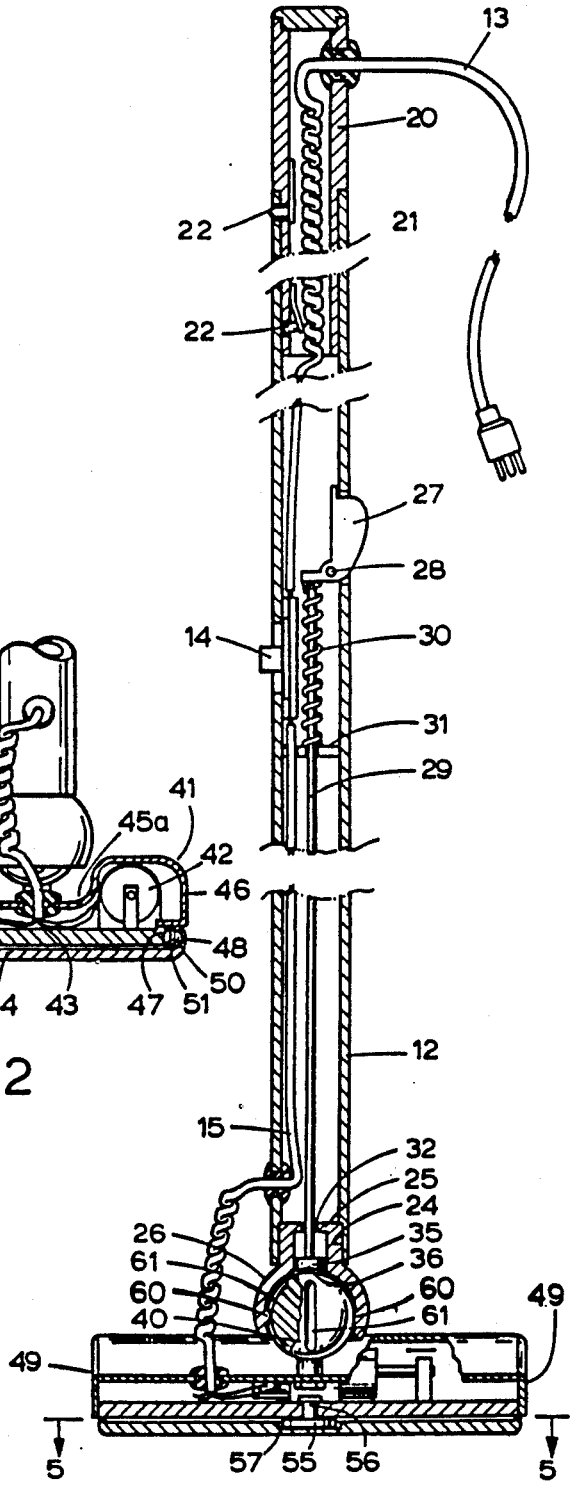
FIG. 3 is a foreshortened vertical sectional view taken along line 3—3 of FIG. 1.

The body 12 is extensible through a slidable handle 20 which has a reduced portion 21 (FIG. 3) slidably received in the free end of the body 12. The handle is fixed in extended or normal position by spring loaded lock means 22. This accommodates higher ceilings when in use.

On the working end of the body 12 is a counterbore 24 which receives a shank 25 of a hollow semi-spherical socket element 26.

A brake actuator 27 is positioned in the body 12 adjacent to the switch 14. The actuator 27 is pivotally mounted on the body 12 at 28 and is linked to a follower rod 29. The handle 27 is urged outwardly by a spring 30 interposed between the actuator 27 and an internal plate 31 fixed in the inside of the body 12. The spring 30 surrounds the follower rod 29 which is slidably positioned in an opening in the plate 31. This guides the rod 29 in its back and forth movement in the body 12 and maintains it in alignment. The leading end of the rod 29 is slidably positioned in an opening 32 in the top of the shank 25 to further guide and maintain the alignment of the rod 29.

Fixed to the leading end of the rod 29 is a brake member 35 which is slidably positioned in the shank 25. The brake member 35 has a segmental spherical braking surface 36 on its working end.

The purpose of the brake member 35 is to bear against a solid spherical ball 40 which is attached to a base plate **11*a* on the sanding head 11. When the actuator 27 is moved into the body 12, the follower rod 29 is moved along the body 12 toward the head 11 to move the brake surface 36 into engagement with the surface of the ball 40 and to lock it in a fixed position, thus locking the sanding head 11** in a fixed position.

Figure 2:
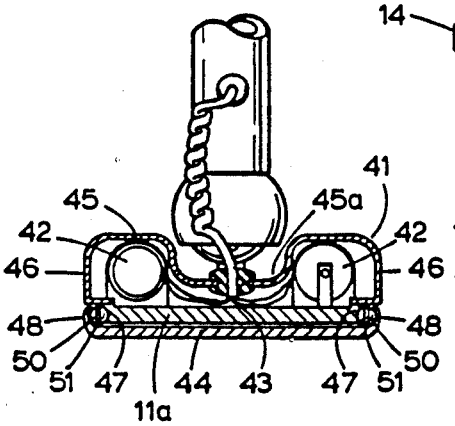
FIG. 2 is a fragmentary sectional view taken along line 2—2 of FIG. 1.

The sanding head 11 is generally rectangular in shape (FIG. 2) and, in addition to the base plate **11*a*, comprises a cover member 41 which houses a set of solenoid actuators 42 fixed to the base plate 11*a*. The actuators 42 are controlled by a solid state changing electric switch 43 that pulses at a predetermined number of times per second to reciprocate a sanding base 44** in a back and forth motion.

The cover 41 has an open bottom, a top member 45 which defines a center channel **45*a*, and longitudinal sides 46 which terminate in outturned circular tracks 47 which form part of a ball bearing slide. The sanding base 44 has curled edges 48 which cooperate with the outturned tracks 47 to define the ball bearing track. The ends of the head 11 are closed by cover plates 49. The balls 50 are held in position by races 51 positioned in the track defined by the edges 47, 48**.

In use sandpaper is adhesively secured to the outer surface of the sanding base 44.

The ball 40 is mounted in the channel 45*a* in the head 11 closely adjacent to the sanding base 44 so that the head 11 is easier to control and the weight of the solenoids or small D.C. motors 42 and switch 43 is closer to the pivot point defined by the ball 40 and socket element 26.

Figure 5:
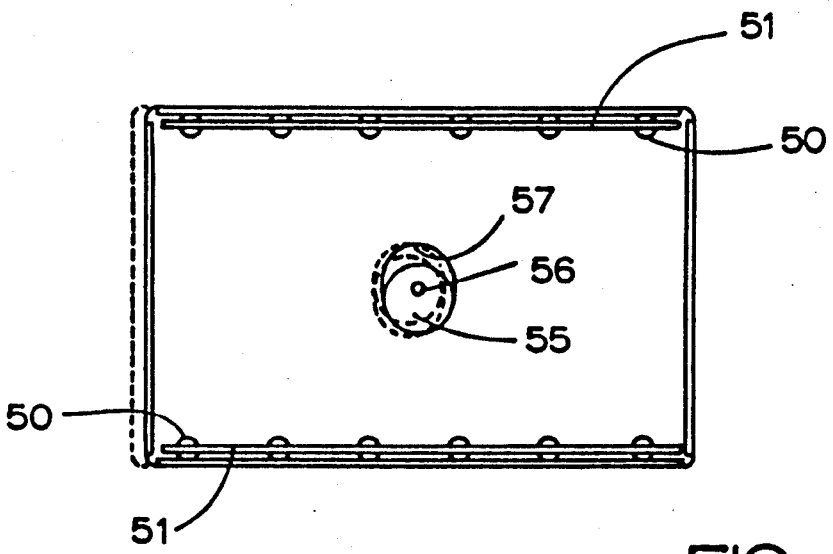
FIG. 5 is a sectional view taken along line 5—5 of FIG. 3.

An eccentric 55 is rotatably pinned at 56 to the base plate 11*a* and is confined in an elliptical slot 57 in the sanding base 44. When the sander is actuated. the eccentric 55 acts as a fly wheel to store energy from movement of the sanding base 44 in one direction and to start it in motion in the opposite direction. It also tends to damp the jolts and impacts from the opposite movements of the solenoids 42. The limits of the movement of the eccentric 55 is shown by the broken lines in FIG. 5.

Figure 4:
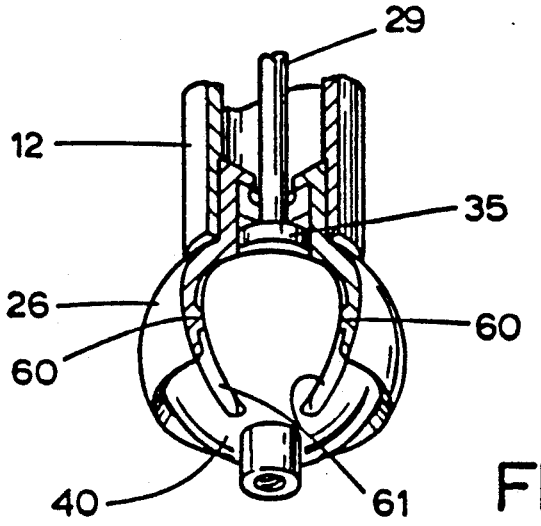
FIG. 4 is a fragmentary perspective view of the ball and socket connection.

An important aspect of the invention is the joint defined by the solid ball 40 and the hollow semi-spherical member 26 (FIG. 4). The member 26 is provided with four opposed semi-spherical detents 60 on the inner surface which ride in grooves 61 in the outer surface of the ball 40. The detents 60 are placed on the medial circumference of the surface 26 and are equally spaced around this circumference. There are four semi-circular grooves 61 placed at 90° with respect to each other. The grooves 61 are equally spaced around the outer surface of the ball 40. Thus the head 11 can be turned in two directions, but cannot rotate. This is important in positioning the head 11 when in use, such as moving the head 11 into and out of corners, etc.

The device has been described as being powered by solenoids, but small light weight D.C. motors can be used.

This invention is intended to cover all changes and modifications of the example of the invention herein chosen for purposes of the disclosure which do not constitute departures from the spirit and scope of the invention.

What is claimed is:

1. A joint for connecting two members so that they can move in two directions but not rotate comprising:

(a) a spherical head, (b) a hollow pocket having a partly spherical inner surface, (c) a series of four detents and four longitudinal grooves on the outer surface of the head and the pocket inner surface each spaced 90° from each other with a detent being trapped in an aligned groove thus allowing the head to tilt longitudinally and laterally but restraining it from rotation, (d) remotely actuated brake means for engaging the outer surface of the head to lock the head and pocket in fixed position, said brake means including a braking member with a segmented braking surface on its working end which is engageable with the spherical head, resilient means normally urging the braking member away from braking engagement with the spherical head, and means for moving the braking member against the resilient means into braking engagement with the spherical head to lock the head and pocket in a predetermined position, and (e) a working member connecting to the head and controlled by movement of the head.

2. The joint of claim 1 wherein the means for moving the braking member includes a hollow stem on the pocket communicating with the inner surface of the pocket, a rod connected to the braking surface and guided through the stem, a remote actuator for moving the rod through the stem, and spring means positioned around the rod and urging the actuator, stem, and braking surface away from the engagement with the head.

* * * * *